US010782066B2

(12) United States Patent
Ji et al.

(10) Patent No.: US 10,782,066 B2
(45) Date of Patent: Sep. 22, 2020

(54) REFRIGERATION CONTROL METHOD FOR REFRIGERATOR AND REFRIGERATOR

(71) Applicant: QINGDAO HAIER JOINT STOCK CO., LTD, Qingdao (CN)

(72) Inventors: Lisheng Ji, Qingdao (CN); Shengyuan Nie, Qingdao (CN); Feifei Qi, Qingdao (CN); Haibo Tao, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 0 days.

(21) Appl. No.: 16/319,103

(22) PCT Filed: Dec. 30, 2016

(86) PCT No.: PCT/CN2016/113935
§ 371 (c)(1),
(2) Date: Feb. 26, 2019

(87) PCT Pub. No.: WO2017/219651
PCT Pub. Date: Dec. 28, 2017

(65) Prior Publication Data

US 2019/0242643 A1 Aug. 8, 2019

(30) Foreign Application Priority Data

Jun. 23, 2016 (CN) ..... 2016 1 0470713

(51) Int. Cl.
*F25D 29/00* (2006.01)
*F25D 11/02* (2006.01)
*F25D 19/00* (2006.01)

(52) U.S. Cl.
CPC ..... *F25D 29/006* (2013.01); *F25D 11/022* (2013.01); *F25D 19/003* (2013.01);
(Continued)

(58) Field of Classification Search
CPC ..... F25D 11/002; F25D 2600/04; F25D 2600/2511; F25D 19/003; F25D 2700/122; F25D 2700/121
See application file for complete search history.

(56) References Cited

U.S. PATENT DOCUMENTS

2010/0115973 A1* 5/2010 Kondou ..... F25B 5/02 62/115
2012/0023980 A1* 2/2012 Lee ..... F25B 1/10 62/115

FOREIGN PATENT DOCUMENTS

CN 1246607 A 3/2000
CN 1382949 A * 12/2002 ..... F25D 29/00
(Continued)

OTHER PUBLICATIONS

English Translation of Xing CN-1382949-A (Year: 2019).*
International Search Report and Written Opinion for Application No. PCT/CN2016/113935 dated Mar. 30, 2017, 14 pages.

*Primary Examiner* — Edward F Landrum
*Assistant Examiner* — Melodee Jefferson
(74) *Attorney, Agent, or Firm* — Alston & Bird LLP

(57) ABSTRACT

A refrigeration control method and a refrigerator. The refrigeration control method for a refrigerator comprises: acquiring the refrigeration state of a first evaporator and the refrigeration state of a second evaporator; when the first evaporator performs refrigeration, acquiring the temperature of a second compartment; when the temperature of the second compartment is greater than the starting temperature of the second compartment and the difference therebetween is less than a first preset threshold, acquiring the temperature of a first compartment and determining whether the temperature of the first compartment is less than a preset first reference temperature, the first reference temperature being calculated according to the starting temperature of the first
(Continued)

compartment and a set adjustment temperature; and when the temperature of the first compartment is less than the first reference temperature, switching the refrigerator into a state where the second evaporator performs refrigeration.

10 Claims, 4 Drawing Sheets

(52) U.S. Cl.
CPC ..... *F25D 29/00* (2013.01); *F25D 29/003* (2013.01); *F25B 2600/2511* (2013.01); *F25D 2600/04* (2013.01); *F25D 2700/122* (2013.01)

(56) References Cited

FOREIGN PATENT DOCUMENTS

| | | | |
|---|---|---|---|
| CN | 1382949 | A | 12/2002 |
| CN | 1384322 | A | 8/2014 |
| CN | 104061750 | A | 9/2014 |
| CN | 106123450 | A | 11/2016 |
| EP | 2781863 | A2 | 9/2014 |
| JP | 2004116841 | | 4/2004 |
| JP | 2012082985 | A | 4/2012 |
| KR | 20050117933 | | 12/2005 |
| WO | 2010122932 | A1 | 10/2010 |

* cited by examiner

REFRIGERATION CONTROL METHOD FOR REFRIGERATOR AND REFRIGERATOR

CROSS-REFERENCE TO RELATED APPLICATIONS

The present application is a national phase entry of International Application No. PCT/CN2016/113935, filed Dec. 30, 2016, which claims priority to Chinese Patent Application No. 201610470713.3, filed Jun. 23, 2016, which are incorporated herein by reference in their entirety.

TECHNICAL FIELD

The present invention relates to the field of household appliances control, and in particular to a refrigeration control method for a refrigerator and a refrigerator.

BACKGROUND OF THE INVENTION

With the development of society and the improvement of people's living standards as well as the increasingly rapid pace of life, people are getting used to buying a lot of food and putting same in a refrigerator, so the demand for refrigerators is also higher and higher.

A conventional refrigerator is generally provided with a refrigerating compartment and a freezing compartment, and the same refrigeration cycle system provides refrigeration capacity to the two compartments via a refrigerating circuit and a freezing circuit. Such a refrigeration cycle system controls the flow direction of the refrigerant by providing a solenoid valve so as to separately perform refrigeration using evaporators correspondingly provided for the refrigerating compartment and the freezing compartment. However, such a refrigeration cycle system can only provide refrigeration capacity to one of the compartments at a time, and cannot handle the situation where the two compartments require the system to provide refrigeration capacity at the same time. In addition, when the refrigeration cycle system switches between the refrigerating circuit and the freezing circuit, especially switching from the freezing circuit to the refrigerating circuit, the refrigerant migration causes a large loss of refrigeration capacity, thus increasing the energy consumption of the refrigerator and reducing the user experience.

SUMMARY OF THE INVENTION

An object of the present invention is to provide a refrigeration control method suitable for use in a parallel dual-cycle system refrigerator.

A further object of the present invention is to appropriately make a selection from evaporators connected in parallel to meet refrigeration requirements of the refrigerator.

Another further object of the present invention is to reduce the loss of refrigeration capacity during refrigerant migration to reduce the energy consumption of the refrigerator.

In particular, the present invention provides a refrigeration control method for a refrigerator, with the refrigerator being provided with a first compartment where a first evaporator performs refrigeration and a second compartment where a second evaporator performs refrigeration, the first evaporator and the second evaporator being arranged in parallel and configured to alternatively perform refrigeration, and the refrigeration control method for a refrigerator comprising: acquiring the refrigeration state of the first evaporator and the refrigeration state of the second evaporator; when the first evaporator performs refrigeration, acquiring the temperature of the second compartment; when the temperature of the second compartment is greater than the starting temperature of the second compartment and the difference between the temperature of the second compartment and the starting temperature of the second compartment is less than a first preset threshold, acquiring the temperature of the first compartment and determining whether the temperature of the first compartment is less than a preset first reference temperature, the first reference temperature being calculated according to the starting temperature of the first compartment and a set adjustment temperature; and when the temperature of the first compartment is less than the first reference temperature, switching the refrigerator into a state where the second evaporator performs refrigeration.

Optionally, when the difference between the temperature of the second compartment and the starting temperature of the second compartment is greater than or equal to the first preset threshold, the refrigerator is switched into a state where the second evaporator performs refrigeration.

Optionally, prior to the step of acquiring the temperature of the first compartment, the method further comprises: determining whether the refrigeration time of the first evaporator is less than a preset refrigeration time threshold; and if yes, performing the step of acquiring the temperature of the first compartment, and if not, switching the refrigerator into a state where the second evaporator performs refrigeration.

Optionally, when the temperature of the first compartment is greater than or equal to the first reference temperature, the state where the first evaporator performs refrigeration is maintained.

Optionally, when the starting temperature of the first compartment is less than the starting temperature of the second compartment and the first evaporator performs refrigeration, the method further comprises: determining whether the temperature of the first compartment is less than the shutdown temperature of the first compartment and whether the temperature of the second compartment is greater than the starting temperature of the second compartment; and when the temperature of the first compartment is less than the shutdown temperature of the first compartment and the temperature of the second compartment is greater than the starting temperature of the second compartment, switching the refrigerator into a state where the second evaporator performs refrigeration.

Optionally, when the starting temperature of the first compartment is greater than the starting temperature of the second compartment and the first evaporator performs refrigeration, the method further comprises: determining whether the temperature of the first compartment is less than the shutdown temperature of the first compartment; and if yes, determining whether the temperature of the second compartment is greater than a second reference temperature, and if yes, switching the refrigerator into a state where the second evaporator performs refrigeration, the second reference temperature being calculated according to the starting temperature and the shutdown temperature of the second compartment.

Optionally, when the starting temperature of the first compartment is less than the starting temperature of the second compartment and both the first evaporator and the second evaporator stop refrigeration, the method further comprises: acquiring the temperature of the first compartment and the temperature of the second compartment; and when the temperature of the first compartment is greater than or equal to the starting temperature of the first compartment and the temperature of the second compartment is greater than or equal to the starting temperature of the second compartment, switching the refrigerator into a state where the second evaporator performs refrigeration.

Optionally, the first reference temperature is calculated according to the sum of the starting temperature of the first compartment and a set adjustment temperature, and the adjustment temperature is calculated by multiplying the difference between the starting temperature and the shutdown temperature of the first compartment by a preset adjustment coefficient.

According to another aspect of the present invention, a refrigerator is further provided. The refrigerator comprises: a refrigerator body with a first compartment and a second compartment defined therein; a first evaporator configured to perform refrigeration for the first compartment; a second evaporator arranged in parallel with the first evaporator and configured to perform refrigeration for the second compartment, the first evaporator and the second evaporator being configured to alternatively perform refrigeration; and a cooling medium switching device configured to acquire the refrigeration state of the first evaporator and the refrigeration state of the second evaporator; when the first evaporator performs refrigeration, acquiring the temperature of the second compartment; when the temperature of the second compartment is greater than the starting temperature of the second compartment and the difference between the temperature of the second compartment and the starting temperature of the second compartment is less than a first preset threshold, acquiring the temperature of the first compartment and determining whether the temperature of the first compartment is less than a preset first reference temperature, the first reference temperature being calculated according to the starting temperature of the first compartment and a set adjustment temperature; and when the temperature of the first compartment is less than the first reference temperature, switching the refrigerator into a state where the second evaporator performs refrigeration.

Optionally, the cooling medium switching device is further configured for: when the difference between the temperature of the second compartment and the starting temperature of the second compartment is greater than or equal to a first preset threshold, switching the refrigerator into a state where the second evaporator performs refrigeration; prior to acquiring the temperature of the first compartment, determining whether the refrigeration time of the first evaporator is less than a preset refrigeration time threshold; and if yes, acquiring the temperature of the first compartment and comparing the temperature with the first reference temperature, and if not, switching the refrigerator into a state where the second evaporator performs refrigeration; and when the temperature of the first compartment is greater than or equal to the first reference temperature, maintaining the state where the first evaporator performs refrigeration.

Optionally, when the starting temperature of the first compartment is less than the starting temperature of the second compartment and the first evaporator performs refrigeration, the cooling medium switching device is further configured for: determining whether the temperature of the first compartment is less than the shutdown temperature of the first compartment and whether the temperature of the second compartment is greater than the starting temperature of the second compartment; and when the temperature of the first compartment is less than the shutdown temperature of the first compartment and the temperature of the second compartment is greater than the starting temperature of the second compartment, switching the refrigerator into a state where the second evaporator performs refrigeration.

Optionally, when the starting temperature of the first compartment is greater than the starting temperature of the second compartment and the first evaporator performs refrigeration, the cooling medium switching device is further configured for: determining whether the temperature of the first compartment is less than the shutdown temperature of the first compartment; and if yes, determining whether the temperature of the second compartment is greater than a second reference temperature, and if yes, switching the refrigerator into a state where the second evaporator performs refrigeration, the second reference temperature being calculated according to the starting temperature and the shutdown temperature of the second compartment.

Optionally, when the starting temperature of the first compartment is less than starting temperature of the second compartment and both the first evaporator and the second evaporator stop refrigeration, the cooling medium switching device is further configured for acquiring the temperature of the first compartment and the temperature of the second compartment; and when the temperature of the first compartment is greater than or equal to the starting temperature of the first compartment and the temperature of the second compartment is greater than or equal to the starting temperature of the second compartment, switching the refrigerator into a state where the second evaporator performs refrigeration.

According to the refrigeration control method for a refrigerator and the refrigerator of the present invention, with the refrigerator being provided with a first compartment where a first evaporator performs refrigeration and a second compartment where a second evaporator performs refrigeration, and the first evaporator and the second evaporator being arranged in parallel and configured to alternatively perform refrigeration, and by means of acquiring the refrigeration state of the first evaporator and the refrigeration state of the second evaporator; when the first evaporator performs refrigeration, acquiring the temperature of the second compartment; when the temperature of the second compartment is greater than the starting temperature of the second compartment and the difference between the temperature of the second compartment and the starting temperature of the second compartment is less than a first preset threshold, acquiring the temperature of the first compartment and determining whether the temperature of the first compartment is less than a preset first reference temperature, the first reference temperature being calculated according to the starting temperature of the first compartment and a set adjustment temperature; and when the temperature of the first compartment is less than the first reference temperature, switching the refrigerator into a state where the second evaporator performs refrigeration. The set adjustment temperature can be used to determine the degree of urgency to which the two compartments require refrigeration, and a selection can be appropriately made from the evaporators connected in parallel when the two compartments require refrigeration at the same time so as to meet the refrigeration requirements of the refrigerator, so that the refrigeration control method for a refrigerator is more appropriate, and the adjustment temperature is set according to the actual requirements of the user, thereby effectively improving the user experience and meeting the differential requirements of the user.

Further, according to the refrigeration control method for a refrigerator and the refrigerator of the present invention, the refrigeration control method for a refrigerator comprises:

when the starting temperature of the first compartment is less than the starting temperature of the second compartment and both the first evaporator and the second evaporator stop refrigeration, acquiring the temperature of the first compartment and the temperature of the second compartment; and when the temperature of the first compartment is greater than or equal to the starting temperature of the first compartment and the temperature of the second compartment is greater than or equal to the starting temperature of the second compartment, switching the refrigerator into a state where the second evaporator performs refrigeration, thereby reducing switching from a state where the compartment having a low starting temperature performs refrigeration to a state where the compartment having a high starting temperature performs refrigeration, so as to effectively avoid the loss of refrigeration capacity during refrigerant migration to avoid the increased energy consumption of the refrigerator.

According to the detailed description of specific embodiments of the present invention below in conjunction with the accompanying drawings, the above and other objects, advantages and features will become more apparent for a person skilled in the art.

BRIEF DESCRIPTION OF THE DRAWINGS

Some of specific embodiments of the present invention will be described below in detail with reference to the accompanying drawings by way of example but not by way of limitation. The same reference signs indicate the same or similar components or parts in the accompanying drawings. It is understood by a person skilled in the art that the accompanying drawings are not necessarily drawn to scale. In the accompanying drawings.

DETAILED DESCRIPTION OF THE INVENTION

Figure 1:
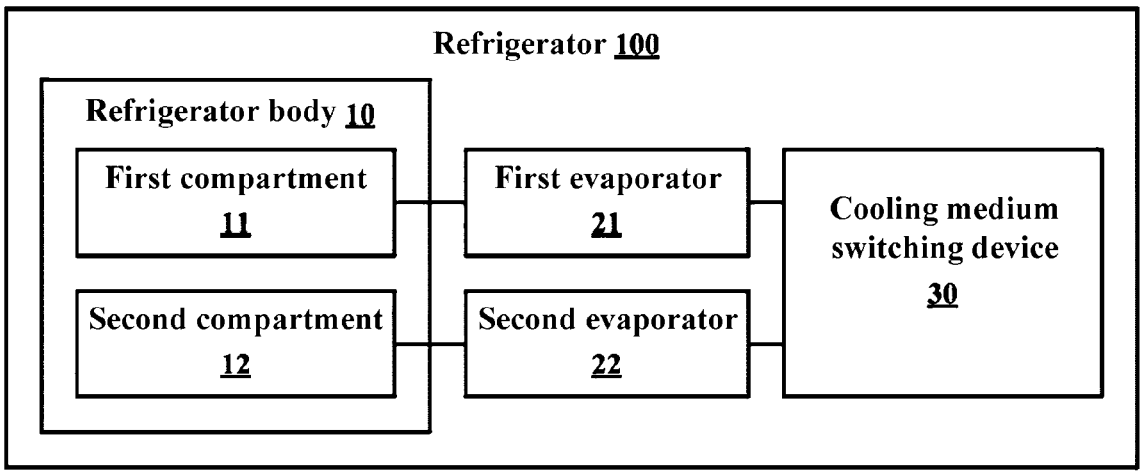
FIG. 1 is a schematic block diagram of a refrigerator according to an embodiment of the present invention.

FIG. 1 is a schematic block diagram of a refrigerator 100 according to an embodiment of the present invention. The refrigerator 100 may generally comprise: a refrigerator body 10, a first evaporator 21, a second evaporator 22 and a cooling medium switching device 30.

Storage compartments are defined inside the refrigerator body 10 of the refrigerator 100. The number and structure of the storage compartments may be configured according to requirements, and the storage compartment is configured as a refrigerating compartment, a freezing compartment, a variable-temperature compartment or a freshness-keeping compartment according to different uses. Each compartment may be divided into multiple storage areas by partition plates, and shelves or drawers are used to store articles. A first compartment 11 and a second compartment 12 are defined inside the refrigerator body 10 of the refrigerator 100 of this embodiment.

The first evaporator 21 is configured to perform refrigeration for the first compartment 11. The second evaporator 22 is arranged in parallel with the first evaporator 21 and is configured to perform refrigeration for the second compartment 12, and the first evaporator 21 and the second evaporator 22 are configured to alternatively perform refrigeration for the first compartment 11 or the second compartment 12.

Figure 2:
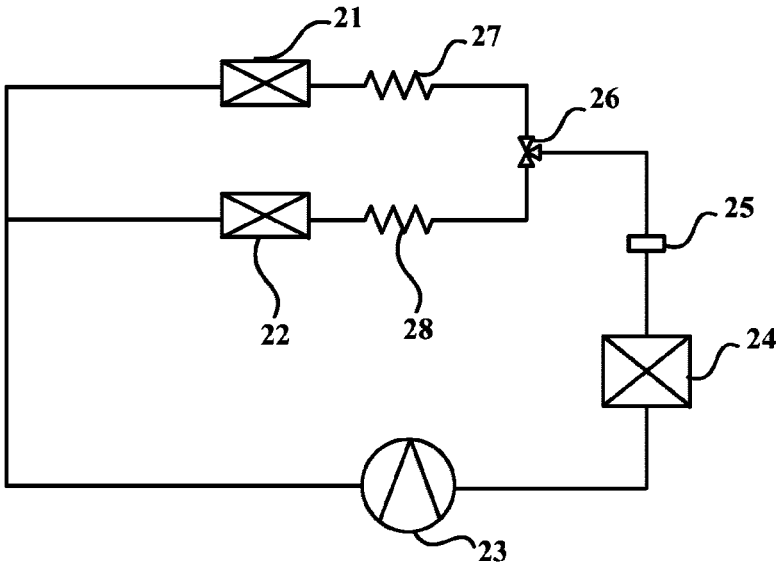
FIG. 2 is a schematic diagram of a parallel refrigeration system in a refrigerator according to an embodiment of the present invention.

FIG. 2 is a schematic diagram of a parallel refrigeration system in the refrigerator 100 as shown in FIG. 1. The parallel refrigeration system comprises: a first evaporator 21, a second evaporator 22, a compressor 23, a condenser 24, a drier-filter 25, a bistable solenoid valve 26, a first capillary tube 27, and a second capillary tube 28. The flow direction of the refrigerant is switched by controlling the bistable solenoid valve 26, so that one of the first evaporator 21 and the second evaporator 22 performs refrigeration.

When the bistable solenoid valve 26 is switched into a state where the first evaporator 21 performs refrigeration, the refrigerant is compressed into a high-temperature and high-pressure gas by the compressor 23 and then enters the condenser 24. The condenser 24 performs heat exchange from a high-temperature and high-pressure gaseous refrigerant to a low-temperature and high-pressure liquid refrigerant so as to release heat to the outside. Then the liquid refrigerant passes through the drier-filter 25 for filtering out impurities and then passes through the first capillary tube 27 or another throttling device. After passing through the first capillary tube 27, the pressure of the refrigerant is reduced, the temperature continues to drop, and the refrigerant turns into a gas-liquid two-phase refrigerant and then enters the first evaporator 21. At this time, the refrigerant is subjected to heat exchange and vaporization in the first evaporator 21 to absorb external heat so as to implement refrigeration, and turns into a high-temperature low-pressure gaseous refrigerant which returns to the compressor to continue the circulation. When the bistable solenoid valve 26 is switched into a state where the second evaporator 22 performs refrigeration, the refrigerant passes through the drier-filter 25 and then passes through the second capillary tube 28 and the second evaporator 22 in sequence. The working process of the refrigeration cycle is similar to the above process.

The bistable solenoid valve 26 serves as an execution mechanism for the cooling medium switching device 30 to switch the flow direction of the refrigerant. In addition, the cooling medium switching device 30 may further comprise a temperature sensor and a data processor, wherein the first compartment 11 and the second compartment 12 may be respectively provided with a temperature sensor for detecting the internal temperature of the first compartment 11 and the internal temperature of the second compartment 12, and the data processor can process the acquired temperature values according to a preset control algorithm, thereby implementing the refrigeration control for the two compartments of the refrigerator.

The cooling medium switching device 30 may be configured for acquiring the refrigeration state of the first evaporator 21 and the refrigeration state of the second evaporator 22; when the first evaporator 21 performs refrigeration, acquiring the temperature of the second compartment 12; when the temperature of the second compartment 12 is greater than the starting temperature of the second compartment 12 and the difference between the temperature of the second compartment 12 and the starting temperature of the second compartment 12 is less than a first preset threshold, acquiring the temperature of the first compartment 11, and determining whether the temperature of the first compartment 11 is less than a preset first reference temperature, the first reference temperature being calculated according to the starting temperature of the first compartment 11 and a set adjustment temperature; and when the temperature of the first compartment 11 is less than the first reference temperature, switching the refrigerator 100 into a state where the second evaporator 22 performs refrigeration. The first compartment 11 and the second compartment 12 may be respectively provided with a temperature sensor to detect the temperature in the first compartment 11 and the temperature in the second compartment 12.

The first reference temperature may be calculated according to the sum of the starting temperature of the first compartment 11 and a set adjustment temperature, and the adjustment temperature is calculated by multiplying the difference between the starting temperature and the shutdown temperature of the first compartment 11 by a preset adjustment coefficient, or the adjustment temperature may be directly set by a user. As an example, the first compartment 11 may be a freezing compartment, and the starting temperature of the freezing compartment is TFU, the shutdown temperature of the freezing compartment is TFD, the adjustment coefficient is vFre, the adjustment temperature is TFga, and the first reference temperature is TFre1, thus TFga=(TFU−TFD)*vFre, and TFre1=TFD+TFga. As a further example, the first compartment 11 may be a refrigerating compartment, and the starting temperature of the refrigerating compartment is TRU, the shutdown temperature of the refrigerating compartment is TRD, the adjustment coefficient is vRre, the adjustment temperature is TRga, and the first reference temperature is TRre1, thus TRga=(TRU−TRD)*vRre, and TRre1=TRD+TRga.

The value of the adjustment coefficient vFre or vRre ranges from 0 to 1. Moreover, the user may set the adjustment coefficient according to the actual requirements. If the user has a strict requirement on refrigeration of the first compartment 11, that is, when the two compartments require refrigeration at the same time, the user prefers the first compartment 11 to perform refrigeration, and the adjustment coefficient may be set small, for example, set to be 0.2. If the user does not have a strict requirement on refrigeration of the first compartment 11, that is, when the two compartments require refrigeration at the same time, the user prefers the second compartment 12 to perform refrigeration, and the adjustment coefficient may be set large, for example, set to be 0.8. If the user gives consideration to the refrigeration of both the first compartment 11 and the second compartment 12, the adjustment coefficient may be set to be 0.5. The above specific values are merely examples and are not intended to limit the present invention.

The refrigerator 100 may also be provided with a display device, and the user may use the display device to set the adjustment coefficient. For example, an interface of the display device may include an adjustment coefficient setting option, and the user sets the adjustment coefficient by means of touching or key-pressing.

The refrigerator 100 of this embodiment can use the set adjustment temperature to determine the degree of urgency to which the two compartments require refrigeration, and appropriately select from the evaporators connected in parallel when the two compartments require refrigeration at the same time so as to meet the refrigeration requirements of the to refrigerator, so that the refrigeration control method for a refrigerator is more appropriate, and the adjustment temperature is set according to the actual requirements of the user, thereby effectively improving the user experience and meeting the differential requirements of the user.

The cooling medium switching device 30 may also be configured for: when the difference between the temperature of the second compartment 12 and the starting temperature of the second compartment 12 is greater than or equal to a first preset threshold, switching the refrigerator 100 into a state where the second evaporator 22 performs refrigeration; prior to acquiring the temperature of the first compartment 11, determining whether the refrigeration time of the first evaporator 21 is less than a preset refrigeration time threshold, and if yes, acquiring the temperature of the first compartment 11 and comparing the temperature with a first reference temperature, and if not, switching the refrigerator 100 into a state where the second evaporator 22 performs refrigeration; and when the temperature of the first compartment 11 is greater than or equal to the first reference temperature, maintaining the state where the first evaporator 21 performs refrigeration.

In the refrigerator 100 of the above embodiment, the first compartment 11 may be a refrigerating compartment, and the second compartment 12 may be a freezing compartment; or the first compartment 11 may be a freezing compartment, and the second compartment 12 may be a refrigerating compartment.

In one specific embodiment, the first compartment 11 of the refrigerator 100 may be a freezing compartment, the second compartment 12 may be a refrigerating compartment, and at this time the starting temperature of the first compartment 11 is less than the starting temperature of the second compartment 12. When the first evaporator 21 performs refrigeration, the cooling medium switching device 30 may also be configured for: determining whether the temperature of the first compartment 11 is less than the shutdown temperature of the first compartment 11 and whether the temperature of the second compartment 12 is greater than the starting temperature of the second compartment 12; and when the temperature of the first compartment 11 is less than the shutdown temperature of the first compartment 11 and the temperature of the second compartment 12 is greater than the starting temperature of the second compartment 12, switching the refrigerator 100 into a state where the second evaporator 22 preforms refrigeration. In this embodiment, where both the first evaporator 21 and the second evaporator 22 stop refrigeration, the cooling medium switching device 30 may also be configured for: acquiring the temperature of the first compartment 11 and the temperature of the second compartment 12; and when the temperature of the first compartment 11 is greater than or equal to the starting temperature of the first compartment 11 and the temperature of the second compartment 12 is greater than or equal to the starting temperature of the second compartment 12, switching the refrigerator 100 into a state where the second evaporator 22 performs refrigeration.

The refrigerator 100 of this embodiment can reduce switching from a state where the compartment having a low starting temperature (for example, the freezing compartment) performs refrigeration to a state where the compartment having a high starting temperature (for example, the refrigerating compartment) performs refrigeration, so as to effectively avoid the loss of refrigeration capacity during refrigerant migration to avoid the increased energy consumption of the refrigerator.

In another specific embodiment, the first compartment 11 of the refrigerator 100 may be a refrigerating compartment, the second compartment 12 may be a freezing compartment, and at this time the starting temperature of the first compartment 11 is obviously greater than the starting temperature of the second compartment 12. When the first evaporator 21 performs refrigeration, the cooling medium switching device 30 may also be configured for: determining whether the temperature of the first compartment 11 is less than the shutdown temperature of the first compartment 11; and if yes, determining whether the temperature of the second compartment 12 is greater than a second reference temperature, and if yes, switching the refrigerator 100 into a state where the second evaporator 22 performs refrigeration, the second reference temperature being calculated according to the starting temperature and the shutdown temperature of the second compartment 12.

Figure 3:
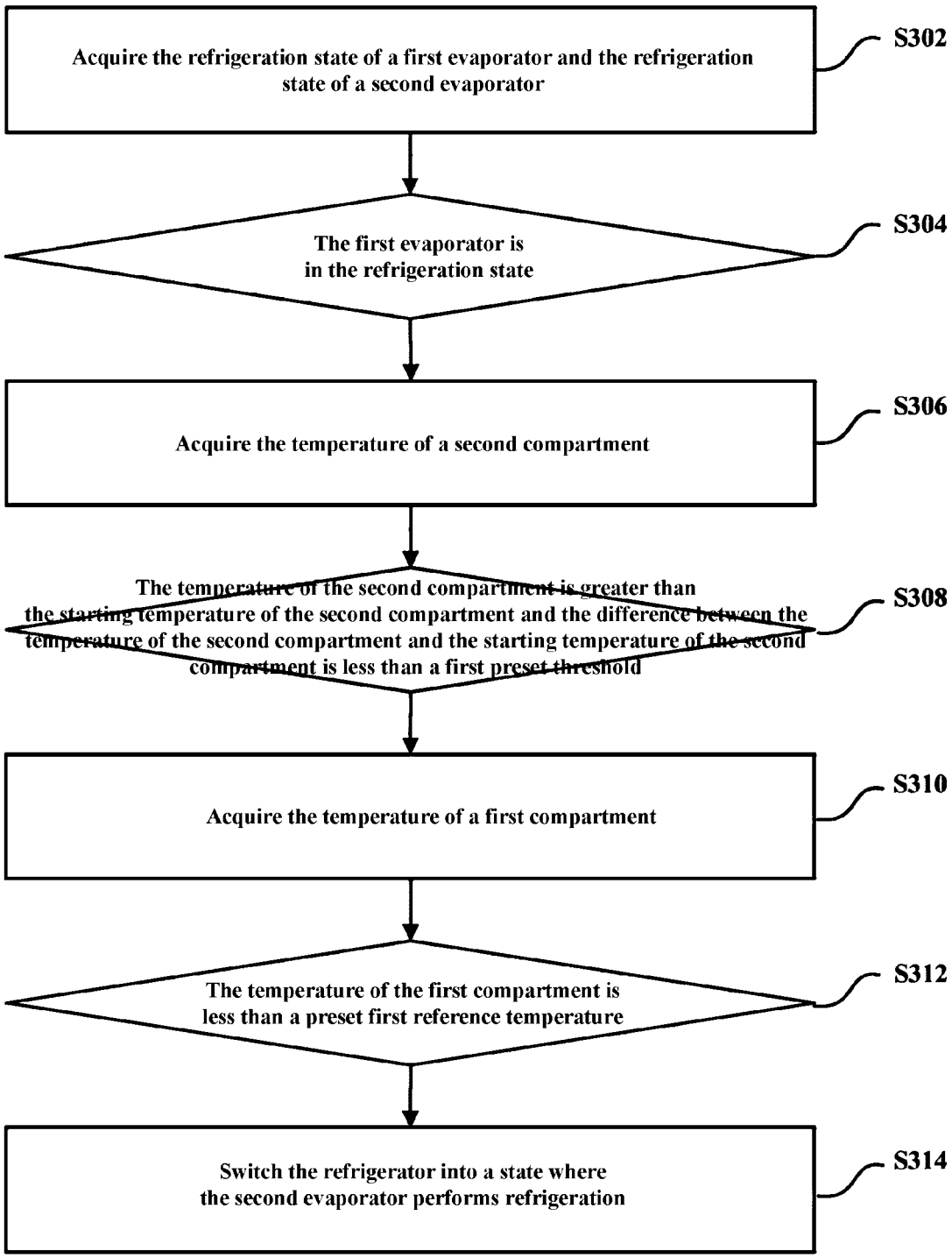
FIG. 3 is a schematic diagram of a refrigeration control method for a refrigerator according to an embodiment of the present invention.

FIG. 3 is a schematic diagram of a refrigeration control method for a refrigerator according to an embodiment of the present invention. The refrigeration control method for a refrigerator may be performed by the refrigerator 100 of any of the above embodiments. As shown, the refrigeration control method for a refrigerator comprises the following steps in sequence:

step S302, acquiring the refrigeration state of the first evaporator 21 and the refrigeration state of the second evaporator 22;

step S304, determining whether the first evaporator 21 is in the refrigeration state, and if yes, performing step S306;

step S306, acquiring the temperature of the second compartment 12;

step S308, determining whether the temperature of the second compartment 12 is greater than the starting temperature of the second compartment 12 and whether the difference between the temperature of the second compartment 12 and the starting temperature of the second compartment 12 is less than the first preset threshold, and if yes, performing step S310;

step S310, acquiring the temperature of the first compartment 11;

step S312, determining whether the temperature of the first compartment 11 is less than a preset first reference temperature, and if yes, performing S314; and step S314, switching the refrigerator 100 into a state where the second evaporator 22 performs refrigeration.

In the refrigeration control method for a refrigerator of this embodiment, the first compartment 11 of the refrigerator 100 may be a refrigerating compartment, and the second compartment 12 may be a freezing compartment; or the first compartment 11 may be a freezing compartment, and the second compartment 12 may be a refrigerating compartment. That is, the refrigeration control method for a refrigerator of this embodiment is suitable for switching from the refrigerating compartment refrigeration to the freezing compartment refrigeration, and is also suitable for switching from the freezing compartment refrigeration to the refrigerating compartment refrigeration.

In step S308, the first preset threshold may be set according to the actual requirements of the user. If the user has a strict requirement on refrigeration of the first compartment, that is, the user considers that the temperature of the first compartment cannot be too higher than the starting temperature of the first compartment, the first preset threshold may be set small, for example, may be set to be 3° C. If the user does not have a strict requirement on refrigeration of the first compartment, that is, the user considers the temperature of the first compartment can be too higher than the starting temperature of the first compartment, the first preset threshold may be set large, for example, may be set to be 6° C. The above specific values are merely examples and are not intended to limit the present invention.

In step S312, the preset first reference temperature is calculated according to the starting temperature of the first compartment 11 and the set adjustment temperature, the first reference temperature is calculated according to the sum of the starting temperature of the first compartment 11 and the set adjustment temperature, and the adjustment temperature is calculated by multiplying the difference between the starting temperature and the shutdown temperature of the first compartment 11 by a preset adjustment coefficient, or the adjustment temperature can be directly set by the user. As an example, the first compartment 11 may be a freezing compartment, and the starting temperature of the freezing compartment is TFU, the shutdown temperature of the freezing compartment is TFD, the adjustment coefficient is vFre, the adjustment temperature is TFga, and the first reference temperature is TFre1, thus TFga=(TFU−TFD)*vFre, and TFre1=TFD+TFga. As a further example, the first compartment 11 may be a refrigerating compartment, and the starting temperature of the refrigerating compartment is TRU, the shutdown temperature of the refrigerating compartment is TRD, the adjustment coefficient is vRre, the adjustment temperature is TRga, and the first reference temperature is TRre1, thus TRga=(TRU−TRD)*vRre, and TRre1=TRD+TRga. The value of the adjustment coefficient vFre or vRre ranges from 0 to 1. Moreover, the user may set the adjustment coefficient according to the actual requirements. If the user has a strict requirement on refrigeration of the first compartment 11, that is, when the two compartments require refrigeration at the same time, the user prefers the first compartment 11 to perform refrigeration, and the adjustment coefficient may be set small, for example, set to be 0.2. If the user does not have a strict requirement on refrigeration of the first compartment 11, that is, when the two compartments require refrigeration at the same time, the user prefers the second compartment 12 to perform refrigeration, and the adjustment coefficient may be set large, for example, set to be 0.8. If the user gives consideration to the refrigeration of both the first compartment 11 and the second compartment 12, the adjustment coefficient may be set to be 0.5. The above specific values are merely examples and are not intended to limit the present invention.

The refrigeration control method for a refrigerator of this embodiment can use the set adjustment temperature to determine the degree of urgency to which the two compartments require refrigeration, and appropriately select from the evaporators connected in parallel when the two compartments require refrigeration at the same time so as to meet the refrigeration requirements of the refrigerator, so that the refrigeration control method for a refrigerator is more appropriate, and the adjustment temperature is set according to the actual requirements of the user, thereby effectively improving the user experience and meeting the differential requirements of the user.

Figure 4:
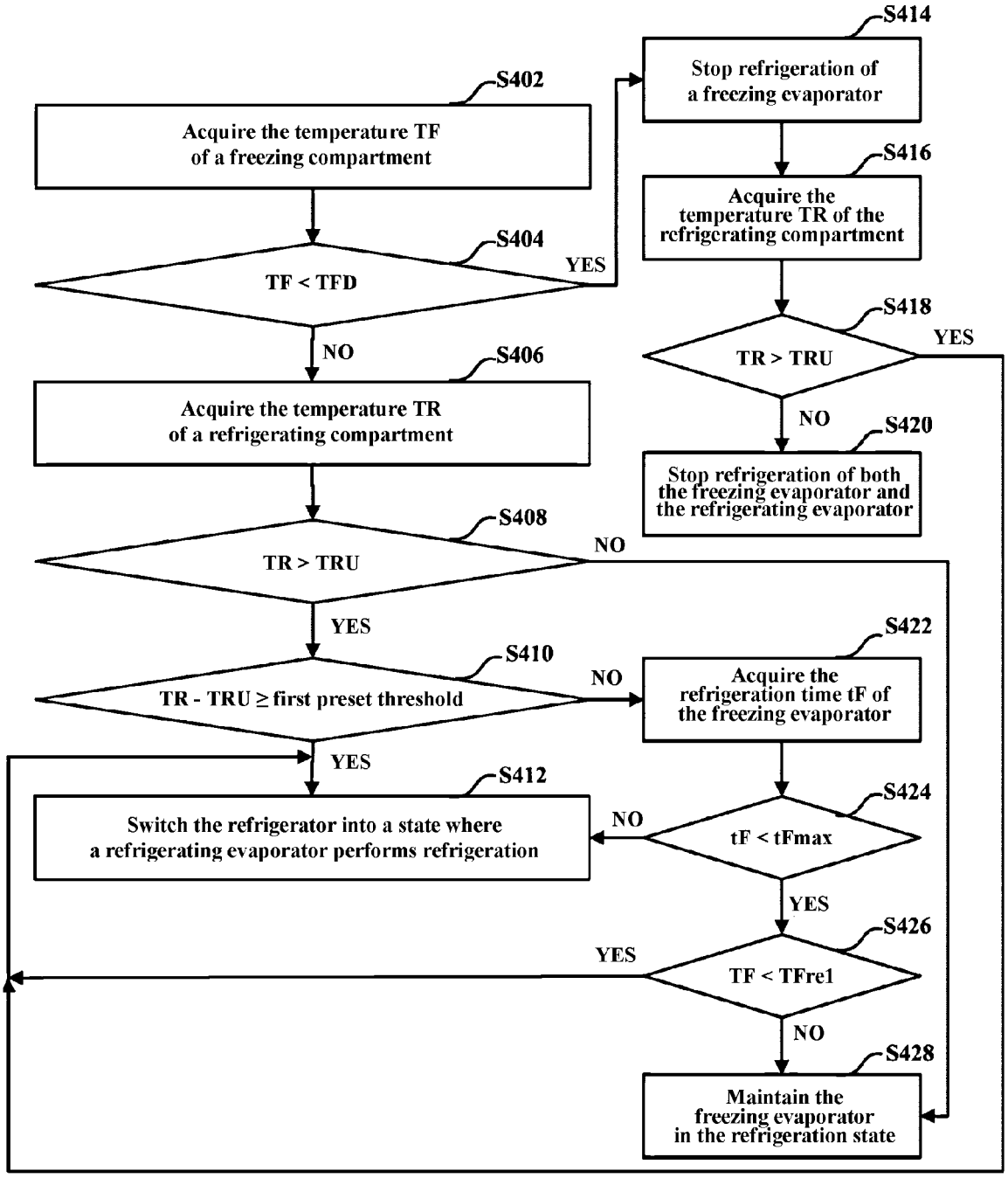
FIG. 4 is a schematic diagram of a refrigeration control method for a refrigerator according to another embodiment of the present invention.

FIG. 4 is a schematic diagram of a refrigeration control method for a refrigerator according to another embodiment of the present invention. In the refrigerator 100 performing the refrigeration control method for a refrigerator, the first compartment 11 is a freezing compartment, the second compartment 12 is a refrigerating compartment, and a freezing evaporator of the freezing compartment is in the refrigeration state. As shown, the refrigeration control method for a refrigerator comprises the following steps in sequence:

step S402, acquiring the temperature TF of the freezing compartment;

step S404, determining whether the temperature TF of the freezing compartment is less than the shutdown temperature TFD of the freezing compartment, and if yes, performing step S414, and if not, performing step S406;

step S406, acquiring the temperature TR of the refrigerating compartment;

step S408, determining whether the temperature TR of the refrigerating compartment is greater than the starting temperature TRU of the refrigerating compartment, and if yes, performing step S410, and if not, performing step S428;

step S410, determining whether the difference between the temperature TR of the refrigerating compartment and the starting temperature TRU of the refrigerating compartment is greater than or equal to a first preset threshold, and if yes, performing step S412, and if not, performing step S422;

step S412, switching the refrigerator 100 into a state where a refrigerating evaporator performs refrigeration, wherein from step S402 to step S412 of the refrigeration control method for a refrigerator of this embodiment, when the temperature of the freezing compartment does not reach the shutdown temperature while the refrigerating compartment has an urgent requirement on refrigeration, the refrigerator 100 is switched into a state where the refrigerating evaporator performs refrigeration;

step S414, if the result of determination in step S404 is yes, stopping refrigeration of the freezing evaporator;

step S416, acquiring the temperature TR of the refrigerating compartment;

step S418, determining whether the temperature TR of the refrigerating compartment is greater than the starting temperature TRU of the refrigerating compartment, and if yes, performing step S412, and if not, performing step S420;

step S420, stopping refrigeration of both the freezing evaporator and the refrigerating evaporator, wherein from step S414 to step S420 of the refrigeration control method for a refrigerator of this embodiment, when the temperature of the freezing compartment reaches the shutdown temperature while the refrigerating compartment does not require refrigeration, both the freezing evaporator and the refrigerating evaporator stop refrigeration;

step S422, if the result of determination in step S410 is no, acquiring the refrigeration time tF of the freezing evaporator;

step S424, determining whether the refrigeration time tF of the freezing evaporator is less than the preset refrigeration time threshold tFmax, and if yes, performing step S426, and if not, performing step S412;

step S426, determining whether the temperature TF of the freezing compartment is less than the first reference temperature TFre1, and if yes, performing step S412, and if not, performing step S428; and step S428, maintaining the freezing evaporator in the refrigeration state.

From step S422 to step S428 of the refrigeration control method for a refrigerator of this embodiment, when the temperature of the freezing compartment does not reach the shutdown temperature while the refrigerating compartment does not have an urgent requirement on refrigeration, the freezing evaporator is maintained in the refrigeration state.

In the above steps, both the first preset threshold in step S410 and the preset refrigeration time threshold tFmax in step S424 may be preset according to the actual requirements, for example, the first preset threshold may be set to be 3° C., and the refrigeration time threshold tFmax may be set to be 30 minutes. The above specific values are merely examples and are not intended to limit the present invention.

After both the freezing evaporator and the refrigerating evaporator stop refrigeration in step S420, the method may further comprise: acquiring the temperature of the freezing compartment and the temperature of the refrigerating compartment; when the temperature of the freezing compartment is greater than or equal to the starting temperature of the freezing compartment and the temperature of the refrigerating compartment is greater than or equal to the starting temperature of the refrigerating compartment, switching the refrigerator 100 into a state where the refrigerating evaporator performs refrigeration. That is to say, when both the refrigerating compartment and the freezing compartment require refrigeration, it is preferred that the refrigerating compartment performs refrigeration, so that the situation of switching from the freezing compartment refrigeration to the refrigerating compartment refrigeration can be reduced, so as to effectively avoid the loss of refrigeration capacity during refrigerant migration to avoid the increased energy consumption of the refrigerator.

In step S426, the first reference temperature may be calculated according to the sum of the starting temperature of the freezing compartment and a set adjustment temperature, and the adjustment temperature is calculated by multiplying the difference between the starting temperature and the shutdown temperature of the freezing compartment by a preset adjustment coefficient, or the adjustment temperature may be directly set by the user. As an example, the starting temperature of the freezing compartment is TFU, the shutdown temperature of the freezing compartment is TFD, the adjustment coefficient is vFre, the adjustment temperature is TFga, and the first reference temperature is TFre1, thus TFga=(TFU−TFD)*vFre, and TFre1=TFD+TFga. The value of the adjustment coefficient vFre ranges from 0 to 1. Moreover, the user may set the adjustment coefficient according to the actual requirements. If the user has a strict requirement on refrigeration of the freezing compartment, that is, when both the refrigerating compartment and the freezing compartment require refrigeration at the same time, the user prefers the freezing compartment to perform refrigeration, and the adjustment coefficient may be set small, for example, set to be 0.2. If the user does not have a strict requirement on refrigeration of the freezing compartment, that is, when both the refrigerating compartment and the freezing compartment require refrigeration at the same time, the user prefers the refrigerating compartment to perform refrigeration, and the adjustment coefficient may be set large, for example, set to be 0.8. If the user gives consideration to the refrigeration of both the refrigerating compartment and the freezing compartment, the adjustment coefficient may be set to be 0.5. The above specific values are merely examples and are not intended to limit the present invention.

The refrigeration control method for a refrigerator of this embodiment is suitable for the situation where the first compartment 11 of the refrigerator 100 is a freezing compartment, the second compartment 12 is a refrigerating compartment, and the freezing evaporator of the freezing compartment is in the refrigeration state, can use the set adjustment temperature to determine the degree of urgency to which the two compartments require refrigeration, and appropriately select from the evaporators connected in parallel when the two compartments require refrigeration at the same time so as to meet the refrigeration requirements of the refrigerator, so that the refrigeration control method for a refrigerator is more appropriate, and the adjustment temperature is set according to the actual requirements of the user, thereby effectively improving the user experience and meeting the differential requirements of the user.

Further, the refrigeration control method for a refrigerator of this embodiment comprises: when both the freezing evaporator and the refrigerating evaporator stop refrigeration, acquiring the temperature of the freezing compartment and the temperature of the refrigerating compartment; when the temperature of the freezing compartment is greater than or equal to the starting temperature of the freezing compartment and the temperature of the refrigerating compartment is greater than or equal to the starting temperature of the refrigerating compartment, switching the refrigerator 100 into a state where the refrigerating evaporator performs refrigeration; and when both the refrigerating compartment and the freezing compartment require refrigeration at the same time, preferring the refrigeration of the refrigerating compartment, so as to reduce the situation of switching from the freezing compartment refrigeration to the refrigerating compartment refrigeration, thereby effectively avoiding the loss of refrigeration capacity during refrigerant migration to avoid the increased energy consumption of the refrigerator.

Figure 5:
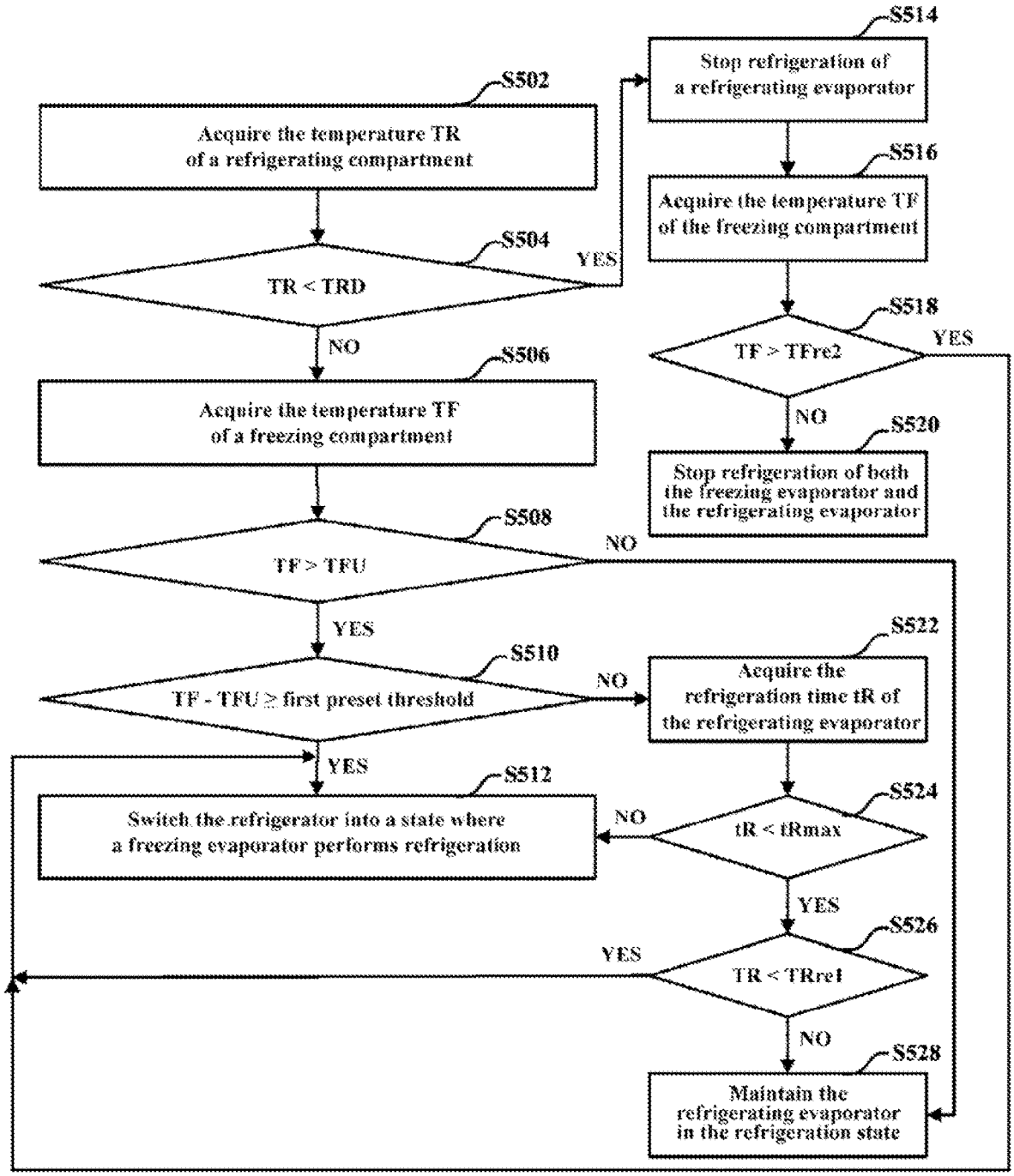
FIG. 5 is a schematic diagram of a refrigeration control method for a refrigerator according to another embodiment of the present invention.

FIG. 5 is a schematic diagram of the refrigeration control method for a refrigerator according to another embodiment of the present invention. In the refrigerator 100 performing the refrigeration control method for a refrigerator, the first compartment 11 is a refrigerating compartment, the second compartment 12 is a freezing compartment, and the refrigerating evaporator of the refrigerating compartment is in the refrigeration state. As shown, the refrigeration control method for a refrigerator comprises the following steps in sequence: step S502, acquiring the temperature TR of the refrigerating compartment;

step S504, determining whether the temperature TR of the refrigerating compartment is less than the shutdown temperature TRD of the refrigerating compartment, and if yes, preforming step S514, and if not, performing step S506;

step S506, acquiring the temperature TF of the freezing compartment;

step S508, determining whether the temperature TF of the freezing compartment is greater than the starting temperature TFU of the freezing compartment, and if yes, performing step S510, and if not, performing step S528;

step S510, determining whether the difference between the temperature TF of the freezing compartment and the starting temperature TFU of the freezing compartment is greater than or equal to a first preset threshold, and if yes, performing step S512, and if not, performing step S522;

step S512, switching the refrigerator 100 into a state where the freezing evaporator performs refrigeration, wherein from step S502 to step S512 of the refrigeration control method for a refrigerator of this embodiment, when the temperature of the refrigerating compartment does not reach the shutdown temperature while the freezing compartment has an urgent requirement on refrigeration, the refrigerator 100 is switched into a state where the freezing evaporator performs refrigeration;

step S514, if the result of determination in step S504 is yes, stopping refrigeration of the refrigerating evaporator;

step S516, acquiring the temperature TF of the freezing compartment;

step S518, determining whether the temperature TF of the freezing compartment is greater than a second reference temperature TFre2, and if yes, performing step S512, and if not, performing step S520;

step S520, stopping refrigeration of both the freezing evaporator and the refrigerating evaporator, wherein from step S514 to step S520 of the refrigeration control method for a refrigerator of this embodiment, when the temperature of the refrigerating compartment reaches the shutdown temperature while the freezing compartment does not require refrigeration, both the freezing evaporator and the refrigerating evaporator stop refrigeration;

step S522, if the result of determination in step S510 is no, acquiring the refrigeration time tR of the refrigerating evaporator;

step S524, determining whether the refrigeration time tR of the refrigerating evaporator is less than a preset refrigeration time threshold tRmax, and if yes, performing step S526, and if not, performing step S512;

step S526, determining whether the temperature TR of the refrigerating compartment is less than a first reference temperature TRre1, and if yes, performing step S512, and if not, performing step S528; and step S528, maintaining the refrigerating evaporator in the refrigeration state.

From step S522 to step S528 of the refrigeration control method for a refrigerator of this embodiment, when the temperature of the refrigerating compartment does not reach the shutdown temperature while the freezing compartment does not have an urgent requirement on refrigeration, the refrigerating evaporator is maintained in the refrigeration state.

In the above steps, both the first preset threshold in step S510 and the preset refrigeration time threshold tRmax in step S524 may be preset according to the actual requirements, for example, the first preset threshold may be set to be 3° C., and the refrigeration time threshold tRmax may be set to be 20 minutes. The above specific values are merely examples and are not intended to limit the present invention.

The first preset threshold in step S510 may be set according to the actual requirements of the user. The first reference temperature in step S526 may be calculated according to the sum of the starting temperature of the refrigerating compartment and the set adjustment temperature, and the adjustment temperature may be calculated by multiplying the difference between the starting temperature and the shutdown temperature of the refrigerating compartment by a preset adjustment coefficient. As an example, the starting temperature of the refrigerating compartment is TRU, the shutdown temperature of the refrigerating compartment is TRD, the adjustment coefficient is vRre, the adjustment temperature is TRga, and the first reference temperature is TRre1, thus TRga=(TRU−TRD)*vRre, and TRre1=TRD+TRga. The value of the adjustment coefficient vRre ranges from 0 to 1. Moreover, the user may set the adjustment coefficient according to the actual requirements. If the user has a strict requirement on refrigeration of the refrigerating compartment, that is, when both the refrigerating compartment and the freezing compartment require refrigeration at the same time, the user prefers the refrigerating compartment to perform refrigeration, and the adjustment coefficient may be set small, for example, set to be 0.2. If the user does not have a strict requirement on refrigeration of the refrigerating compartment, that is, when both the refrigerating compartment and the freezing compartment require refrigeration at the same time, the user prefers the freezing compartment to perform refrigeration, and the adjustment coefficient may be set large, for example, set to be 0.8. If the user gives consideration to the refrigeration of both the refrigerating compartment and the freezing compartment, the adjustment coefficient may be set to be 0.5. The above specific values are merely examples and are not intended to limit the present invention.

The second reference temperature in step S518 is calculated according to the starting temperature and the shutdown temperature of the freezing compartment. For example, the starting temperature of the freezing compartment is TFU, the shutdown temperature of the freezing compartment is TFD, and the second reference temperature is TFre2, thus TFre2=(TFU−TFD)*0.5, wherein 0.5 is a preset coefficient, which can be preset according to the actual requirements, and the value of the preset coefficient ranges from 0 to 1.

The refrigeration control method for a refrigerator of this embodiment is suitable for the situation where the first compartment 11 of the refrigerator 100 is a refrigerating compartment, the second compartment 12 is a freezing compartment, and the refrigerating evaporator of the refrigerating compartment is in the refrigeration state, can use the set adjustment temperature to determine the degree of urgency to which the two compartments require refrigeration, and appropriately select from the evaporators connected in parallel when the two compartments require refrigeration at the same time so as to meet the refrigeration requirements of the refrigerator, so that the refrigeration control method for a refrigerator is more appropriate, and the adjustment temperature is set according to the actual requirements of the user, thereby effectively improving the user experience and meeting the differential requirements of the user.

Further, the refrigeration control method for a refrigerator of this embodiment comprises: after the refrigerating evaporator stops refrigeration, determining whether the temperature of the freezing compartment is greater than the second reference temperature, and if the result is yes, switching the refrigerator 100 into a state where the freezing evaporator performs refrigeration, wherein the second reference temperature is calculated according to the starting temperature and the shutdown temperature of the freezing compartment, and the second reference temperature is less than the starting temperature of the freezing compartment, so that the freezing compartment can perform refrigeration in advance to implement supplement of refrigeration capacity, and the situation of switching from the freezing compartment refrigeration to the refrigerating compartment refrigeration can be reduced, so as to effectively avoid the loss of refrigeration capacity during refrigerant migration to avoid the increased energy consumption of the refrigerator.

To this end, it is recognized by a person skilled in the art that although multiple exemplary embodiments of the present invention have been shown and described in detail herein, many other variations or modifications complying with the principles of the present invention can be directly determined or derived from the contents disclosed in the present invention without departing from the spirit and scope of the present invention. Therefore, the scope of the present invention should be construed and considered as covering all of such other variations or modifications.

What is claimed is:

1. A refrigeration control method for a refrigerator, with the refrigerator being provided with a first compartment where a first evaporator performs refrigeration and a second compartment where a second evaporator performs refrigeration, the first evaporator and the second evaporator being arranged in parallel and configured to alternatively perform refrigeration, and the refrigeration control method comprising:

acquiring a temperature of the second compartment, wherein the temperature of the second compartment is greater than a starting temperature of the second compartment and a difference between the temperature of the second compartment and the starting temperature of the second compartment is less than a first preset threshold;

prior to a step of acquiring a temperature of the first compartment, determining whether the following:

if the refrigeration time of the first evaporator is less than a preset refrigeration time threshold, performing the step of acquiring the temperature of the first compartment, and if the refrigeration time of the first evaporator is not less than a preset refrigeration time threshold, switching the refrigerator into a state where the second evaporator performs refrigeration;

acquiring the temperature of the first compartment and determining whether the temperature of the first compartment is less than a preset first reference temperature, the first reference temperature being calculated according to a starting temperature of the first compartment and a set adjustment temperature;

when the temperature of the first compartment is less than the first reference temperature, switching the refrigerator into a state where the second evaporator performs refrigeration; and when the temperature of the first compartment is greater than or equal to the first reference temperature, maintaining the state where the first evaporator performs refrigeration.

2. The method according to claim 1, further comprising:

acquiring the temperature of the second compartment, wherein the difference between the temperature of the second compartment and the starting temperature of the second compartment is greater than or equal to the first preset threshold; and switching the refrigerator into a state where the second evaporator performs refrigeration.

3. The method according to claim 1, wherein the starting temperature of the first compartment is less than the starting temperature of the second compartment, the method further comprising:

acquiring the temperatures of the first compartment and the second compartment, wherein the temperature of the first compartment is less than the shutdown temperature of the first compartment and the temperature of the second compartment is greater than the starting temperature of the second compartment; and switching the refrigerator into a state where the second evaporator performs refrigeration.

4. The method according to claim 1, wherein the starting temperature of the first compartment is greater than the starting temperature of the second compartment, the method further comprising:

acquiring the temperature of the first compartment, wherein the temperature of the first compartment is less than the shutdown temperature of the first compartment;

acquiring the temperature of the second compartment, wherein the temperature of the second compartment is greater than a second reference temperature; and switching the refrigerator into a state where the second evaporator performs refrigeration, the second reference temperature being calculated according to the starting temperature and the shutdown temperature of the second compartment.

5. The method according to claim 1, wherein the starting temperature of the first compartment is less than the starting temperature of the second compartment, the method further comprising:

acquiring the state of the refrigerator when both the first evaporator and the second evaporator stop refrigeration;

acquiring the temperature of the first compartment and the temperature of the second compartment, wherein the temperature of the first compartment is greater than or equal to the starting temperature of the first compartment and the temperature of the second compartment is greater than or equal to the starting temperature of the second compartment; and switching the refrigerator into a state where the second evaporator performs refrigeration.

6. The method according to claim 1, wherein the first reference temperature is calculated according to the sum of the starting temperature of the first compartment and a set adjustment temperature, and an adjustment temperature is calculated by multiplying the difference between the starting temperature and a shutdown temperature of the first compartment by a preset adjustment coefficient.

7. A refrigerator, comprising:

a refrigerator body with a first compartment and a second compartment defined therein;

a first evaporator configured to perform refrigeration for the first compartment;

a second evaporator arranged in parallel with the first evaporator and configured to perform refrigeration for the second compartment, the first evaporator and the second evaporator being configured to alternatively perform refrigeration; and a cooling medium switching device configured to:

acquire a temperature of the second compartment, wherein the temperature of the second compartment is greater than a starting temperature of the second compartment and a difference between the temperature of the second compartment and the starting temperature of the second compartment is less than a first preset threshold, prior to a step of acquiring a temperature of the first compartment, determining whether the following:

if the refrigeration time of the first evaporator is less than a preset refrigeration time threshold, performing the step of acquiring the temperature of the first compartment, and if the refrigeration time of the first evaporator is not less than a preset refrigeration time threshold, switching the refrigerator into a state where the second evaporator performs refrigeration, acquire a temperature of the first compartment and determining whether the temperature of the first compartment is less than a preset first reference temperature, the first reference temperature being calculated according to a starting temperature of the first compartment and a set adjustment temperature;

acquire the temperature of the first compartment, wherein the temperature of the first compartment is less than the first reference temperature, and switch the refrigerator into a state where the second evaporator performs refrigeration.

8. The refrigerator according to claim 7, wherein the starting temperature of the first compartment is less than the starting temperature of the second compartment and the first evaporator performs refrigeration, the cooling medium switching device is further configured for acquiring the temperatures of the first compartment and the second compartment, wherein the temperature of the first compartment is less than a shutdown temperature of the first compartment and the temperature of the second compartment is greater than the starting temperature of the second compartment; and switching the refrigerator into a state where the second evaporator performs refrigeration.

9. The refrigerator according to claim 7, wherein the starting temperature of the first compartment is greater than the starting temperature of the second compartment and the first evaporator performs refrigeration, the cooling medium switching device is further configured for acquiring the temperature of the first compartment, wherein the temperature of the first compartment is less than a shutdown temperature of the first compartment; and acquiring the temperature of the second compartment, wherein the temperature of the second compartment is greater than a second reference temperature, and switching the refrigerator into a state where the second evaporator performs refrigeration, the second reference temperature being calculated according to the starting temperature and the shutdown temperature of the second compartment.

10. The refrigerator according to claim 7, wherein the starting temperature of the first compartment is less than the starting temperature of the second compartment and both the first evaporator and the second evaporator stop refrigeration, the cooling medium switching device is further configured for acquiring the temperature of the first compartment and the temperature of the second compartment, wherein the temperature of the first compartment is greater than or equal to the starting temperature of the first compartment and the temperature of the second compartment is greater than or equal to the starting temperature of the second compartment, and switching the refrigerator into a state where the second evaporator performs refrigeration.

* * * * *